252-99 AU 115 EX
9/1/87 OR 4,690,770

United States Patent [19]

Jeschke et al.

[11] Patent Number: 4,690,770

[45] Date of Patent: Sep. 1, 1987

[54] BLOCK-FORM DETERGENT FREE FROM ALKALI HYDROXIDES FOR USE IN DISHWASHING MACHINES AND A PROCESS FOR ITS PRODUCTION

[75] Inventors: Peter Jeschke, Neuss; Theodor Altenschoepfer, Duesseldorf; Jochen Jacobs, Wuppertal; Klaus Schumann, Erkrath, all of Fed. Rep. of Germany

[73] Assignee: Henkel Kommanditgesellschaft auf Aktien, Dusseldorf, Fed. Rep. of Germany

[21] Appl. No.: 868,913

[22] Filed: May 29, 1986

[30] Foreign Application Priority Data

May 30, 1985 [DE] Fed. Rep. of Germany ..... 3519354

[51] Int. Cl.[4] ..... C11D 7/18

[52] U.S. Cl. ..... 252/99; 252/102; 252/135; 252/174

[58] Field of Search ..... 252/174, 135, 99, 102

[56] References Cited

U.S. PATENT DOCUMENTS

| | | | |
|---|---|---|---|
| 2,412,819 | 12/1946 | MacMahon | 252/138 |
| 3,390,092 | 6/1968 | Keast et al. | 252/99 |
| 3,816,320 | 6/1974 | Corliss | 252/99 |
| 3,933,670 | 1/1976 | Brill et al. | 252/99 |
| 3,936,386 | 2/1976 | Corliss et al. | 252/99 |
| 4,083,795 | 4/1978 | Joubert | 252/99 |
| 4,219,436 | 8/1980 | Gromer et al. | 252/135 |

FOREIGN PATENT DOCUMENTS

| | | |
|---|---|---|
| 3769 | 9/1979 | European Pat. Off. . |
| 003769 | 9/1979 | European Pat. Off. . |
| 1442885 | 7/1976 | United Kingdom . |

*Primary Examiner*—Josephine L. Barr
*Attorney, Agent, or Firm*—Ernest G. Szoke; Henry E. Millson, Jr.; Real J. Grandmaison

[57] ABSTRACT

A block-form detergent free of alkali metal hydroxides for use in dishwashing machines which contain from 65 to 85% by weight to a mixture of anhydrous sodium metasilicate and anhydrous pentasodium triphosphate in a ratio of from 1:1 to 1:2 and from 0.2 to 4% by weight of uniformly distributed active chlorine donors which are, for example, trichloroisocyanuric acid. The production process comprises heating sodium metasilicate to 45° to 55° C. to obtain a clear melt and then adding other constituents, the pentasodium triphosphate and the active chlorine donor being added last, and pouring the melt into flexible molds in which it is left to solidify into blocks. The detergents are stable for storage with good dissolving power.

20 Claims, No Drawings

BLOCK-FORM DETERGENT FREE FROM ALKALI HYDROXIDES FOR USE IN DISHWASHING MACHINES AND A PROCESS FOR ITS PRODUCTION

BACKGROUND OF THE INVENTION

1. Field of the Invention

Powder-form, granular or tableted detergents for dishwashing machines consist essentially of pentasodium triphosphate, alkali silicate, mainly alkali metasilicate, and optionally a low-foaming, preferably chlorine-stable, nonionic surfactant and bleaches, preferably those which release active chlorine in aqueous solution. They are used above all to facilitate the removal of tea, coffee or fruit juice stains.

Because of their high content of alkali silicates and pentasodium triphosphate, the detergents are strongly alkaline, their in-use solutions having a pH value of from about 11 to 12. Sodium hydroxide is not added because, in view of the normal contact times in domestic dishwashing machines, porcelain, glazed-on decorative patterns and glasses would be affected by the high alkalinity. This phenomenon is known as corrosion. By contrast, silicate synergistically supports the detergent effect of the triphosphate and inhibits corrosion in certain concentrations in the triphosphate/silicate mixture.

Known detergents of the type in question are generally produced by standard methods, such as mixing or granulation. In powder form or granulate form, they are also used in the usual concentrations, i.e. in quantities of from about 30 to 50 g per machine load.

2. Description of the Prior Art

Powder-form or granular detergents of the type in question are described, for example, in British Pat. No. 1,442,885 and in U.S. Pat. Nos. 3,816,320, 3,936,386, 3,933,670, and 4,083,795.

U.S. Pat. No. 3,390,092 discloses disc-like tablets which are produced from simple mixtures of known detergent ingredients using a tabletting aid.

Tablets of the type mentioned above are also described in U.S. Pat. No. 4,219,436. The content of alkaline components (hereinafter referred to as active substance [AS]), including the proportion of alkali silicates and pentaalkalitriphosphates, is of the order of 65 to 95% by weight, based on the tablets as a whole. Accordingly, detergent tablets such as these based on compressed raw materials fully correspond in their composition to powder-form or granular detergents.

The disadvantage of producing a tablet based on compressed individual components is that mechanical strength is inverse to the dissolving rate. Because of this tabletting aids and so-called disintegrating agents have to be added. Their function is, on the one hand, to ensure homogeneity of the powder-form or granulated raw materials during the compression molding operation and, on the other hand, to facilitate disintegration of the tablet on contact with water by swelling of the disintegrating agent, so that better solubility is obtained. However, neither additive is of any value to the washing process as such, in other words, the additives in question reprsent ballast and, in addition, take time to incorporate in the detergent.

U.S. Pat. No. 2,412,819 describes briquetted detergents for dishwashing machines which are produced simply by mixing together all the alkaline-reacting active substances, such as for example up to 65% by weight, based on the detergent as a whole, of sodium silicates and pentasodium triphosphate and, if necessary, water if the preferred water of hydration of the compounds mentioned is not sufficient, and then gently heating the mixture with stirring to 90°-100° C. until a uniformly molten mass is obtained, subsequently pouring the melt thus formed into molds and leaving it to solidify into a compact crystal aggregate. No additions of active chlorine donors are mentioned in U.S. Pat. No. 2,412,819. This is understandable because the detergents themselves are strongly alkaline and, like many substances which it would be desirable to add, but which are sensitive to alkali, the active chlorine donors would be inactivated during the actual fusion process.

Detergents in the form of fused blocks for dishwashing machines are also described in European Pat. No. 3,769. In most cases, the detergents described contain large amounts of alkali hydroxides. However, Example 8 discloses a composition which is free from alkali hydroxides and although, in that example, the active chlorine donor is stirred directly into the subsequently solidifying aqueous solution of the ingredients, the chlorine donor is generally added in the form of a separate core. In this example, the AS-content is only 60% by weight, based on the detergent as a whole, which is too low for use in domestic dishwashing machines. Since the patent specification repeatedly mentions, even in comparison tests, the well known sensitivity of active chlorine donors to alkalis, it can not be assumed that active chlorine donors can be directly incorporated into strongly alkaline block-form detergents free from alkali hydroxides.

BRIEF STATEMENT OF INVENTION

It has now surprisingly been found that it is possible by the fusion process to obtain block-form detergents free of alkali metal hydroxides for use in dish washing machines which contain from about 65 to about 85% by weight, preferably from about 70 to about 80% by weight, based on the weight of the detergent as a whole, of a mixture of alkali metal silicates and pentaalkalitriphosphates and also, in uniform distribution, organic active chlorine donors.

DETAILED DESCRIPTION OF THE INVENTION

Other than in the operating examples, or where otherwise indicated, all numbers expressing quantities of ingredients or reaction conditions used herein are to be understood as modified in all instances by the term "about."

Accordingly, the present invention relates to detergents in the form of fused blocks free from alkali metal hydroxides for use in dishwashing machines, containing from about 65 to about 85% by weight, and preferably from about 70 to about 80% by weight, based on the weight of the detergent as a whole, of a mixture of alkali metal silicates and pentaalkalitriphosphates and, in uniform distribution, active chlorine donors.

Preferred alkali metal silicates are alkali metasilicates, advantageously in the form of sodium metasilicate.9-$H_2O$, sodium metasilicate.6$H_2O$ and sodium metasilicates 5$H_2O$. The quantities of silicates used amount to between about 5 and about 60% by weight, and preferably to between about 10 and about 50% by weight, based on the detergent as a whole. However, the alkali metal metasilicates containing water of hydration may even be partly replaced by the anhydrous compound and such replacement is desirable because high active substance contents can be adjusted in this way for an optimal ratio of alkali silicate to pentaalkalitriphosphate.

The pentaalkalitriphosphate used is in an amount of from about 5 to about 50% by weight, and preferably from about 5 to about 45% by weight, based on the detergent as a whole. The pentaalkalitriphosphate is used as hexahydrate or as a mixture of hexahydrate with small quantities of anhydrous pentasodium triphosphate calculated to give a total water content of about 5.5 moles. In this case, too, anhydrous compounds may be used to obtain optimal active substance combinations and contents.

The optimal ratio of pentasodium triphosphate to sodium metasilicate (both anhydrous) is from about 1:1 to about 1:2, and preferably from about 1:1 to about 1:1.7.

Suitable organic active chlorine donors for use in the invention are the various chlorinated compounds of isocyanuric acid, such as trichloroisocyanuric acid (TICA), Na/K-dichloroisocyanurate, Na-dichloro isocyanurate dihydrate (Na-DCC-$2H_2O$). Also useful are chlorine donors such as Na-monochloroamidosulfonate (=N-chlorosulfamate) and sodium N-chloro-p-toluene sulfonic acid amide ("Chloramine T"). Inorganic active chlorine donors, such as for example chloride of lime, lithium or calcium hypochlorite, may also be used, but the organic chlorine donors are preferred. These chlorine donors are used in quantities of from about 0.2 to about 4% by weight, and preferably in quantities of from about 0.5 to about 2% by weight based on the active chlorine content of the detergent and may be determined for example by iosometric titration.

The total water content of the block-form detergent is from about 11 to about 34.8% by weight, and preferably from about 18 to about 29.5% by weight and is preferably introduced by the water of crystallization content of the alkaline-reacting active substances. Accordingly, any calculation of the water content must be based on these compounds. Although small quantities of free water may be added to balance the weight, they do not fall within the scope of the invention.

It has been found that it is possible to work at lower and, therefore, safer temperatures than in the prior art, namely at about 45° to about 60° C., and preferably at about 50° to about 55° C., providing the sodium metasilicate.$9H_2O$ is first heated at between 45°-55° C. to form a melt and the other constituents, optionally containing water of hydration, are then added with stirring or kneading, the pentasodium triphosphate derivative and the active chlorine donors being added last, and the still liquid melt is then poured into preferably flexible molds of any shape and allowed to solidify into blocks.

The solidification process can take from a few minutes to approximately 1 hour, depending on the size of the mold. Depending on their composition, the fused blocks are very hard, hard, or not very hard, but in any case have a uniform composition throughout and dissolve quickly in use.

EXAMPLES

Example 1

Quantities of 150 g of detergents having the following compositions were prepared (figures in % by weight):

| | 1a | 1b | 1c |
|---|---|---|---|
| $Na_2SiO_3.9\ H_2O$ | 52.3 | 49.5 | 46.5 |
| $Na_2SiO_3$ | 18.5 | 20.6 | 22.8 |
| $Na_5P_3O_{10}$ | 28.2 | 28.9 | 29.6 |
| Trichloroisocyanuric acid | 1.0 | 1.0 | 1.0 |

The $Na_2SiO_3.9H_2O$ was first heated to about 53° C. until a clear melt was formed. After addition of the other active ingredients, the melt was thoroughly stirred and poured into molds in which it solidified in a few minutes.

The active substance (AS) content as defined above was as follows:

| | 1a | 1b | 1c |
|---|---|---|---|
| AS (Alkaline components as active substance) | 68.7% | 70.3% | 72.0% |

After 24 hours, the active chlorine (A-Cl) content was determined, the theoretically calculated value being obtained for all three compositions.

| | 1a | 1b | 1c |
|---|---|---|---|
| % A—Cl (theoretical) | 0.91 | 0.91 | 0.91 |
| Found | 0.90 | 0.88 | 0.94 |

Example 2

A detergent having the following composition (figures in % by weight) was prepared in a quantity of 150 g:

| | |
|---|---|
| $Na_2SiO_3$ | 18.0% |
| $Na_2SiO_3.5\ H_2O$ | 14.0% |
| $Na_2SiO_3.9\ H_2O$ | 36.0% |
| $Na_5P_3O_{10}$ | 31.0% |
| Trichloroisocyanuric acid | 1.0% |

In this case, as in Example 1, $Na_2SiO_3.9H_2O$ was heated together with $Na_2SiO_3.5H_2O$ to about 53° C. until a clear melt was formed. After addition of the other components, the melt was thoroughly stirred and poured into molds in which it solidified in a few minutes.

The active substances (AS) content amounted to 72.5%.

After 24 hours, the active chlorine content was determined and amounted to 0.93% (theoretical 0.91%).

Example 3

In order to demonstrate the superiority of the detergents according to the invention to the detergents according to European Pat. No. 3,769, a fused block having the following composition (figures in % by weight) was prepared:

| | |
|---|---|
| $Na_2SiO_3.9\ H_2O$ | 53.0% |
| $Na_2SiO_3.5\ H_2O$ | 18.6% |
| $Na_5P_3O_{10}$ | 26.0% |
| Na—dichloroisocyanurate dihydrate | 2.4% |

The detergent block was prepared as described in Example 2. By using a combination of $Na_2SiO_3.9H_2O$ and $Na_2SiO_3.5H_2O$, its composition was adjusted in such a way that, overall, the same quantities of water were present as in Example 8 of European Pat. No. 3,769. It was found that, to prepare the melt according to this Example 8, the suspension had to be stirred for about 30 minutes at 55° to 60° C. until it began to turn viscous and could be poured into molds. Measures such as these are cost-intensive and therefore impracticable for commercial processes. Storage at 25° C./85% relative humidity produced the following losses of active chlorine:

| | Example 3 Loss | European Patent No. 3,769 (Example 8) Loss |
|---|---|---|
| 5 weeks | 38% | 85% |
| 12 weeks | 49% | 100% |

The results illustrate a clear advantage for the present invention. In this connection, it is important to bear in mind that compositions containing less water show even better stability.

We claim:

1. A storage stable detergent in the form of fused blocks made from a liquid melt free of alkali metal hydroxide for use in dishwashing machines containing from about 65 to about 85% by weight, based on the weight of the detergent, of a mixture of alkali metal silicates and pentaalkalitriphosphates, said silicates being present in an amount of between about 5 and about 60% by weight, and being selected from sodium metasilicate nonahydrate, sodium metasilicate hexahydrate, sodium metasilicate pentahydrate, sodium metasilicate anhydrous, and mixtures thereof, and homogeneously distributed throughout said detergent from about 0.2 to about 4% by weight of a chlorine donor.

2. An alkali metal hydroxide-free, storage stable detergent in the form of a fused block made from a liquid melt consisting essentially of, based on the total weight of the detergent; from about 65 to about 85% of a mixture of sodium metasilicates and pentasodium triphosphates, the ratio of said triphosphates to said metasilicates on an anhydrous basis being from about 1:1 to about 1:2 wherein said metasilicates are selected from the group consisting of sodium metasilicate nonahydrate, sodium metasilicate hexahydrate, sodium metasilicate pentahydrate, sodium metasilicate anhydrous, and mixtures thereof, from about 11 to about 34.8% of total water, and from about 0.2 to about 4% of an organic chlorine donor homogeneously distributed throughout said detergent.

3. The detergent composition of claim 2, wherein the organic chlorine donor is a chlorinated isocyanuric acid.

4. The detergent composition of claim 3, wherein the chlorine donor is trichloroiscyanuric acid.

5. The detergent composition of claim 3, wherein the chlorine donor is sodium dichloroiscyanurate or its dihydrate.

6. The detergent composition of claim 2, wherein the chlorine donor is Na-monochloroamidosulfonate.

7. The detergent composition of claim 2, wherein the chlorine donor is sodium N-chloro-p-toluene sulfonic acid amide.

8. The detergent composition of claim 2, wherein the amount of said mixture of sodium metasilicates and pentasodiumtriphosphates is from about 70 to about 80%, the ratio of said triphosphates to said metasilicates is from about 1:1 to about 1:1.7, the amount of total water is from about 18 to about 29.5%, and the amount of chlorine donor is from about 0.5 to about 2%.

9. The detergent composition of claim 8, wherein the chlorine donor is trichloroisocyanuric acid.

10. The detergent composition of claim 8, wherein the chlorine donor is sodium dichloroisocyanurate dihydrate.

11. A process for preparing a homogeneous alkali metal hydroxide-free, storage stable detergent composition in the form of fused blocks, said composition consisting essentially of, based on the total weight of the detergent; from about 65 to about 85% of a mixture of sodium metasilicates and pentasodium triphosphates, the ratio of said triphosphates to said silicates on an anhydrous basis being from about 1:1 to about 1:2, from about 11 to about 34.8% of total water, and from about 0.2 to about 4% of an organic chlorine donor, homogeneously distributed throughout said detergent which comprises heating sodium metasilicate nonahydrate at about 45° to about 60° C. to a clear melt and adding the remaining ingredients with stirring, the pentasodium triphosphate and the chlorine donor being added last and while the mixture is liquid, and pouring the mixture into a mold to cool and solidify.

12. The process of claim 11, wherein the chlorine donor is a chlorinated isocyanuric acid.

13. The process of claim 1, wherein the chlorine donor is trichloroisocyanuric acid.

14. The process of claim 12, wherein the chlorine donor is sodium dichloroisocyanurate or its dihydrate.

15. The process of claim 11, wherein the chlorine donor is Na-monochloroamidosulfonate.

16. The process of claim 11, wherein the chlorine donor is sodium N-chloro-p-toluene sulfonic acid amide.

17. The storage stable detergent of claim 1 wherein said pentaalkalitriphosphates are selected from pentaalkalitriphosphate hexahydrate, and a mixture of pentaalkalitriphosphate hexahydrate and pentaalkalitriphosphate anhydrous.

18. The storage stable detergent of claim 1 wherein said detergent contains from about 11 to about 34.8% by weight of water, based on the weight of said detergent.

19. The process of claim 11 wherein said pentasodium triphosphates are selected from pentasodium triphosphate hexahydrate, and a mixture of pentasodium triphosphate hexahydrate and pentasodium triphosphate anhydrous.

20. The process of claim 11 wherein said sodium metasilicates are present in an amount of between about 5 and about 60% by weight and are selected from the group consisting of sodium metasilicate nonahydrate, sodium metasilicate hexahydrate, sodium metasilicate pentahydrate, sodium metasilicate anhydrous, and mixtures thereof.

* * * * *